US005139195A

United States Patent [19]

McClure

[11] Patent Number: 5,139,195

[45] Date of Patent: Aug. 18, 1992

[54] LIDDED CARTONS WITH IMPROVED LOCKING

[75] Inventor: Jack A. McClure, Garden City, Kans.

[73] Assignee: Inland Container Corporation, Indianapolis, Ind.

[21] Appl. No.: 754,582

[22] Filed: Sep. 4, 1991

[51] Int. Cl.[5] ..... B65D 5/20; B65D 43/16

[52] U.S. Cl. ..... 229/143; 229/150; 229/151

[58] Field of Search ..... 229/143, 149, 150, 151, 229/154

[56] References Cited

U.S. PATENT DOCUMENTS

| | | | |
|---|---|---|---|
| 2,727,675 | 12/1955 | Mairs et al. | 229/151 |
| 3,029,996 | 4/1962 | Drummond | 229/154 |
| 3,933,300 | 1/1976 | Dempster | 229/149 |
| 3,998,379 | 12/1976 | Myers et al. | 229/151 |
| 4,175,691 | 11/1979 | Cornell et al. | 229/150 |
| 4,291,830 | 9/1981 | Sorenson | 229/151 |
| 4,316,563 | 2/1982 | Turner et al. | 229/151 |
| 4,339,069 | 7/1982 | Poteet | 229/151 |
| 4,620,666 | 11/1986 | Lacasa et al. | 229/151 |
| 4,770,339 | 9/1988 | Weimer | 229/143 |

*Primary Examiner*—Gary E. Elkins

*Attorney, Agent, or Firm*—Fitch, Even, Tabin & Flannery

[57] ABSTRACT

Carton apparatus includes lid members having locking tabs received in pockets formed in triple layer sidewalls. The intermediate layer of the sidewall defines a recess for receiving the locking tab, and forms a pocket when inner and outer sidewall layers are brought into contact with the intermediate sidewall layer. The intermediate sidewall layer includes locking edges which engage locking edges on the locking tabs. The tab-receiving pockets may be either open or closed.

12 Claims, 6 Drawing Sheets

LIDDED CARTONS WITH IMPROVED LOCKING

BACKGROUND OF THE INVENTION

1. Field of the Invention

The present invention pertains to paperboard containers having lids, and in particular to such containers having arrangements for locking the lids to sides of the carton.

2. Description of the Related Art

Paperboard containers in use today are typically made from a one or two-piece blank which is folded to form a three-dimensional receptacle and cover. While the cover may be adhesively secured to the body of the container, it is sometimes desirable to secure the cover without use of adhesive, for easy opening on a later occasion, after the container is filled with a product. It has been found convenient to provide a container cover in the form of hinged lids which swing down on top of an open top container receptacle portion. Over the years, various arrangements have been provided for the temporary but secure locking of the lid portions in a fully closed position. However, improvements are still being sought, particularly for containers such as those used to transport food and food products, which must be fully closed to prevent intrusion of dust and the like, and sometimes for resistance to product pilferage.

SUMMARY OF THE INVENTION

It is an object of the present invention to provide a carton having multiple layered sidewalls which is constructed from a unitary blank, and which includes partially overlapping hinged lid portions.

Another object of the present invention is to provide a secure but releasable locking of the lid portions in a closed position.

A further object according to the present invention is to provide a carton of the above-described type which has various degrees of protection against dust intrusion.

These and other objects according to the present invention which will become apparent from studying the appended description and drawings are provided in a carton apparatus having triple layer sidewall means, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said endwall panels and said floor panel and hingedly connected to said endwall panels along hinge lines;

a pair of outer sidewall panels hingedly connected to the remaining pair of opposed sides of said floor panel;

a sidewall subassembly coupled to each side of said endwall panels, each sidewall subassembly comprising hingedly connected inner and intermediate sidewall panels, folded against one another with said intermediate sidewall panels arranged in pairs overlying respective common outer sidewall panels, the inner and intermediate sidewall panels having opposed free end portions with upper and lower parts, the intermediate sidewall free end portions being spaced from one another so as to expose portions of the inner sidewall folded thereagainst so as to define a pocket between inner and outer sidewall panels, the intermediate sidewall free end portions having stepped edges with upper parts spaced closer together than their lower parts so as to form a downwardly facing locking edge; and locking tabs carried on one lid panel, having an inverted T-shape configuration with a stem portion extending from said lid panel and laterally extending locking ears receivable in said pocket so as to engage the locking edge.

DETAILED DESCRIPTION OF THE PREFERRED EMBODIMENTS

Figure 1:
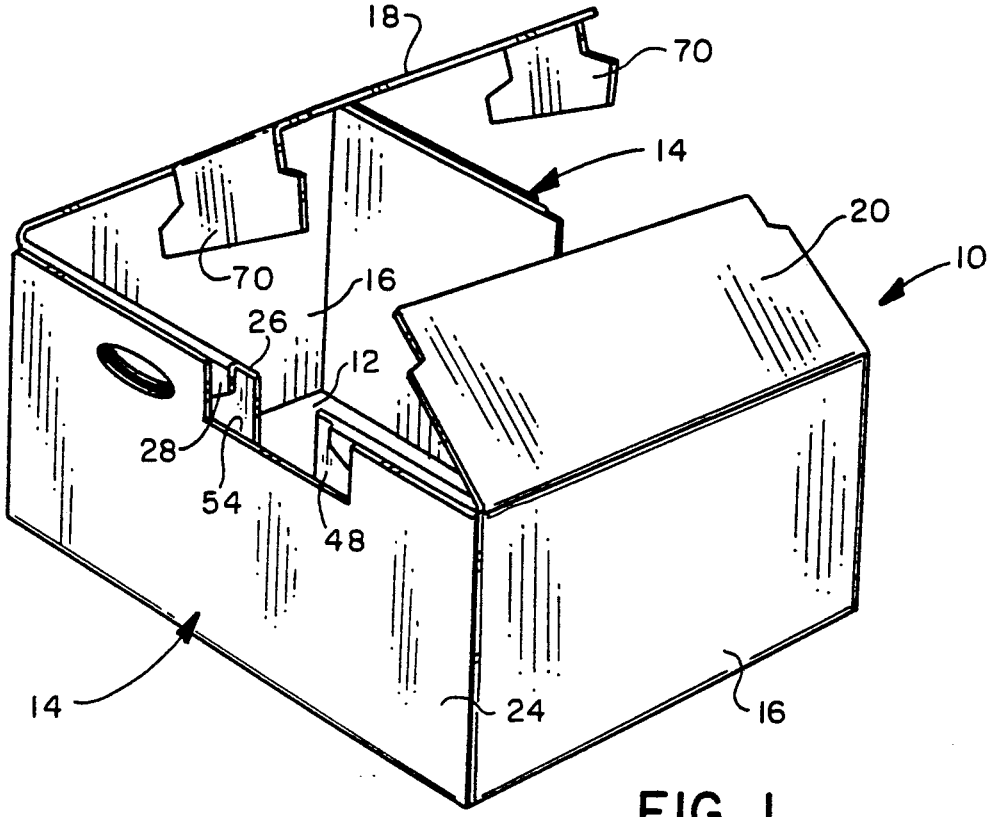
FIG. 1 is a perspective view of a first embodiment of a carton constructed according to principles of the present invention.
Figure 2:
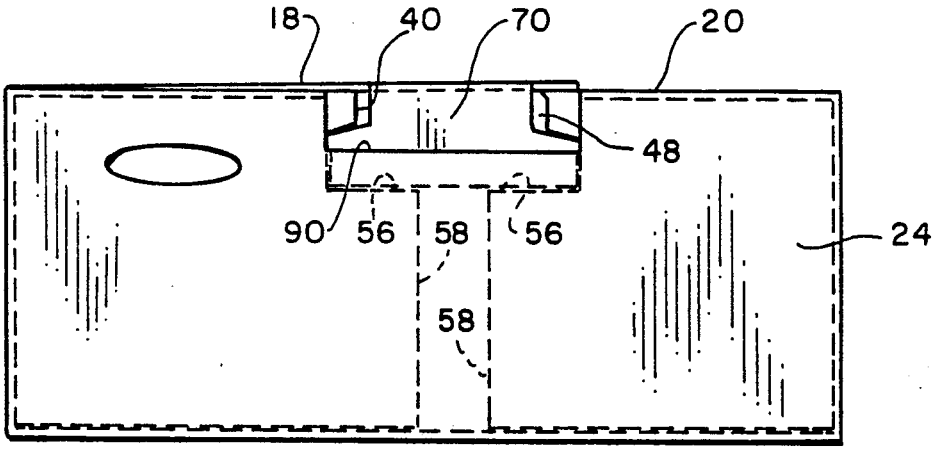
FIG. 2 is a side elevational view showing the sidewall construction thereof.
Figure 3:
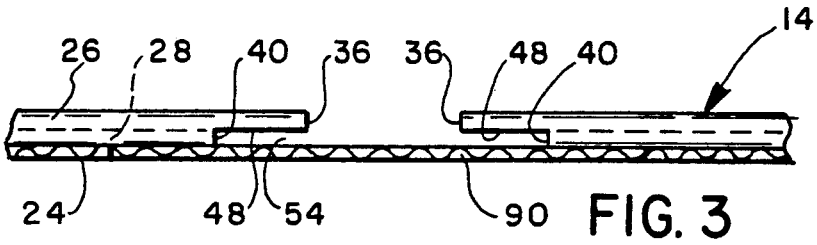
FIG. 3 is a top plan view showing a pocket construction thereof.
Figure 4:
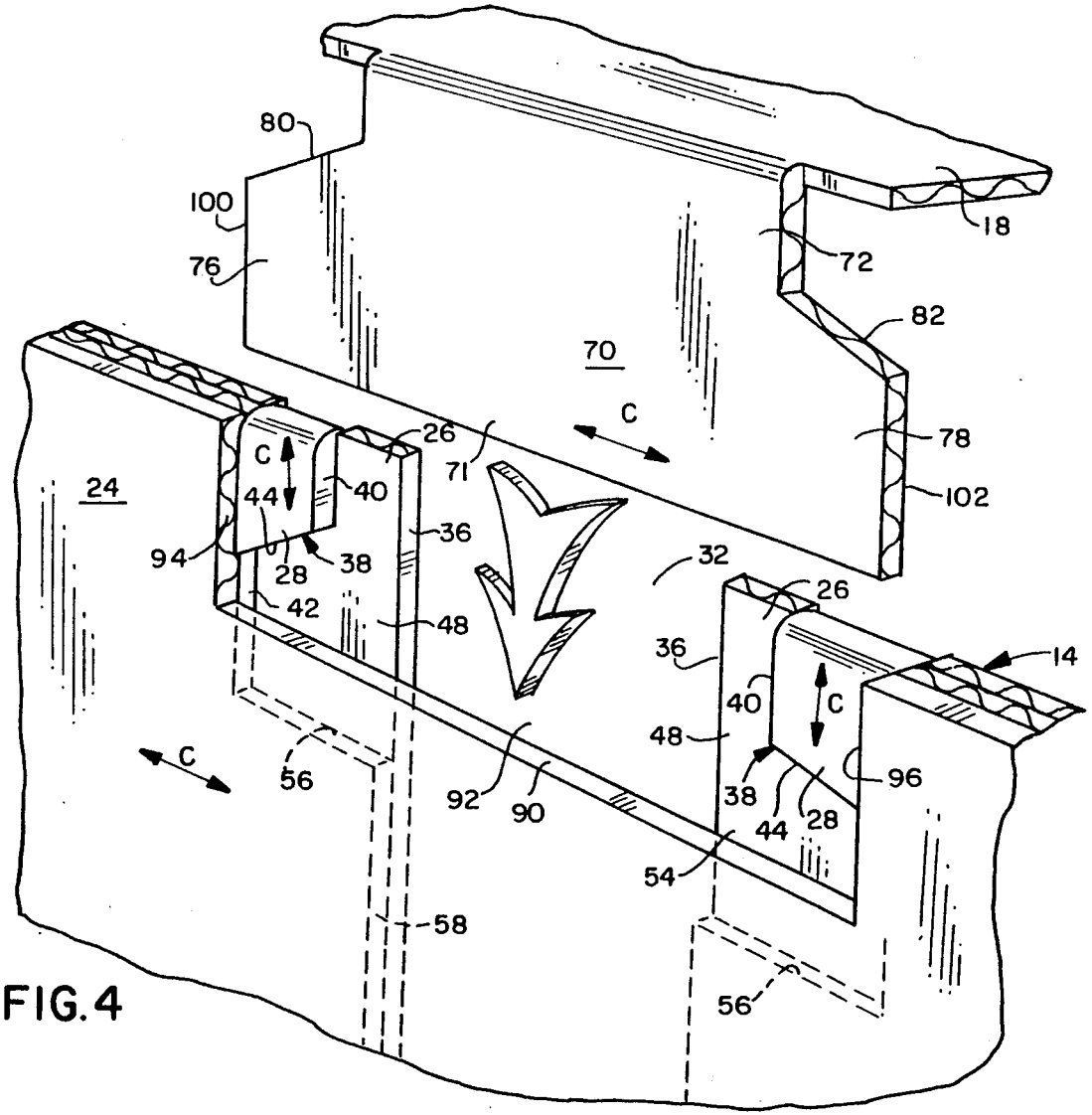
FIG. 4 is a fragmentary perspective view of the pocket.
Figure 5:
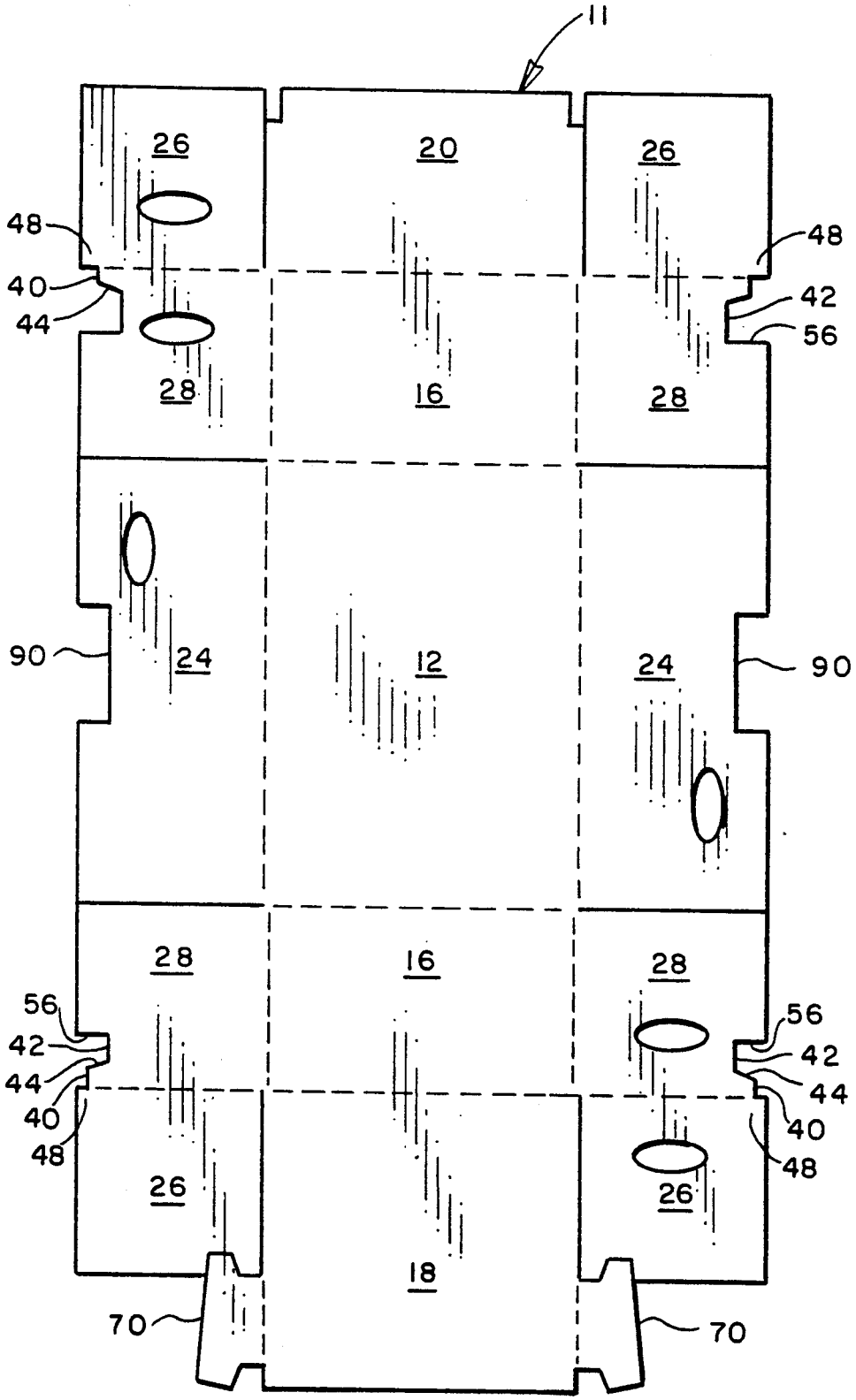
FIG. 5 is a plan view of a blank from which the carton is constructed.

Referring now to the drawings, and initially to FIG. 1, a container according to principles of the present invention is generally indicated at 10. The container 10 has a floor 12, sidewalls 14 and endwalls 16. A pair of lid members 18, 20 extend from opposite ends of the carton. Preferably, carton 10 is fabricated from a single integral blank, preferably the blank 11 illustrated in FIG. 5.

According to one aspect of the present invention, the sidewalls 14 are of a triple-layer construction and include outer, inner and intermediate layers 24, 26 and 28, respectively. In the preferred embodiment, the inner and intermediate sidewalls 26, 28 form a sub-assembly hingedly connected to the endwalls 16, with the intermediate layers of the sub-assembly folded over the inner layers, and pressed against the outer sidewall layer 24 which extends between endwalls 16, overlying a pair of sidewall sub-assemblies. In the preferred embodiment, the outer sidewall 24 is bonded to the intermediate sidewalls 28 with a suitable adhesive and optionally, the intermediate sidewalls may be bonded to the inner sidewall layers 26 if desired.

As can be seen in the drawings, the outer sidewall layer 24 extends the full length of carton 10, but the inner and intermediate sidewall layers of a carton side are spaced apart from one another so as to form a gap 32 in a medial portion of the carton sidewall. The inner sidewall layers 26 have opposed free edges 36 which are spaced apart, on either side of gap 32. If desired, the free edges of the inner sidewall layers 26 can be spaced close together or even abutting one another. The intermediate sidewall layers 28 have stepped, opposed edges 38 including an upper portion 40, a lower portion 42 and an intermediate portion 44. The stepped edges 38 of the intermediate sidewall layers 28 are spaced apart a greater amount than the spacing between inner sidewall edges 36, so as to expose edge surface portions 48 of the inner sidewall layers.

The upper portions 40 of stepped edges 38 are spaced more closely together than the lower portions 42 with the intermediate portions 44 consequently being downwardly facing. According to one aspect of the present invention, the edge construction 38 forms a pocket 54 between inner and outer sidewall layers 24, 26 and the stepped edges 38. In the preferred embodiment, the intermediate edge portions 44 are inclined toward one another at upwardly converging angles. The lower portion 42 of stepped edges 38 are terminated at horizontal edges 56 which extend to free edges 58, preferably located adjacent the free edges 36 of inner layers 26.

The lid members 18, 20 are preferably partially overlapping at their free edges, and lid 20 is preferably folded under the overlying lid member 18. A pair of locking tabs 70 are carried adjacent the free edge of lid 18. The locking tabs 70 having a generally inverted T-shape, with an enlarged head portion 71 receivable in pocket 54, and a stem portion 72 extending from lid 18. The locking tab 70 has a pair of opposed ear portions 76, 78 with inclined, upwardly converging locking edges 80, 82.

In use, the locking tab 70 is inserted in pocket 54, with lower portions of the locking tab camming against the exposed surface portions 48 of the inner sidewall layers, and with the outer surface of the locking tab sliding past the medial edge 90 of a three-sided notch or recess 92 formed in outer sidewall layer 24. The remaining edges 94, 96 of recess 92 guide the upright edges 100, 102 of the locking tab, as the tab is inserted in pocket 54.

When the locking tab is fully inserted in pocket 54, substantially the entire portion of the locking tab, including the stem portion 72 is aligned co-planar with the intermediate sidewall layers 28, being securely retained between the inner sidewall layers 26 and the common outer sidewall layer 24. The locking edges 80, 82 of tab 70 abut the locking edges 44 of the intermediate sidewall layers 28 to provide a secure locking of the lid members in a closed position. According to one aspect of the present invention, the mating locking edges 80, 82 and 44 are cut on a bias or angle with respect to the direction of corrugation c of the paperboard blank 11, so as to maintain the strength of the paperboard material, further enhancing the secure locking of the lid members.

It will now be appreciated that the carton constructed according to principles of the present invention provides a container that can be easily opened and securely reclosed due to the exposed nature of the locking surfaces of locking tab 70 If, however, a more permanent closure is required. The present invention also contemplates a concealed pocket lock which will now be described.

Figure 6:
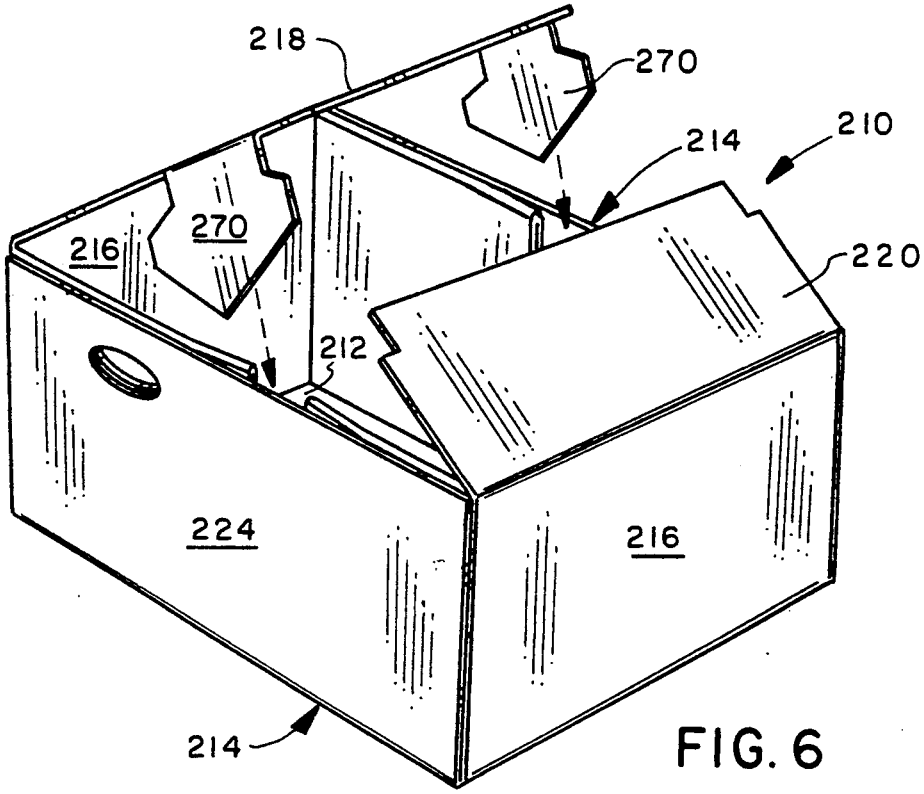
FIG. 6 is a perspective view of a second embodiment of a carton according to principles of the present invention.
Figure 7:
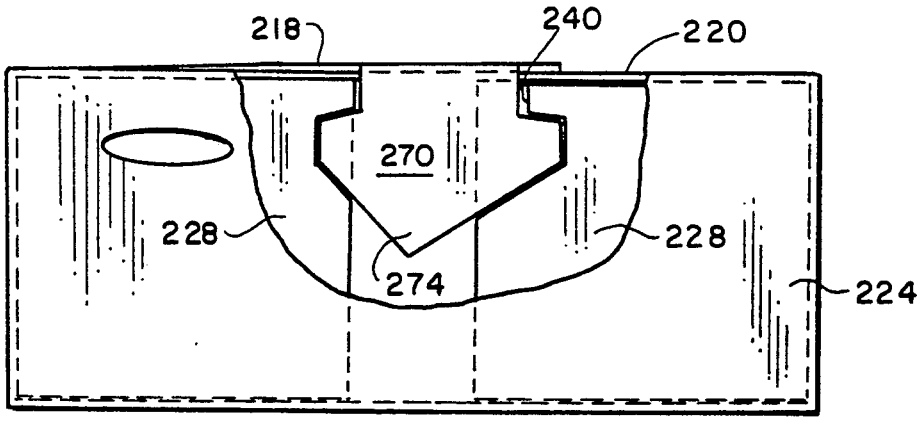
FIG. 7 is a side elevational view showing the sidewall construction thereof.

Turning now to FIG. 6, a second preferred embodiment of a container according to principles of the present invention is generally indicated 210. The container 210 has a floor 212, sidewalls 214 and endwalls 216. A pair of lid members 218, 220 extend from opposite ends of the carton 210. Preferably, the carton 210 is fabricated from a single integral blank, preferably the blank 211 illustrated in FIG. 10.

As with the carton 10, the sidewalls 214 of carton 210 are preferably of a triple-layer construction, and include outer, inner and intermediate layers 224, 226 and 228, respectively. In the preferred embodiment, the inner and intermediate sidewalls 226, 228 form a sub-assembly connected together along a fold or a hinge line 229 with the sub-assembly hingedly connected to the endwalls 216. The intermediate layers 228 of the sub-assembly are folded over the inner layers 226 and are pressed between the inner and outer layers 226, 224. The outer layer 224 extends between endwalls 216 and overlies a pair of sidewall sub-assemblies. In the preferred embodiment, the outer sidewall 224 is bonded to the intermediate sidewalls 228 with a suitable adhesive and if desired, the intermediate sidewalls 228 are preferably bonded to the inner and/or outer sidewall layers 226, 224, respectively.

The outer sidewall layer 224 extends the full length of carton 210, but preferably the inner and intermediate sidewall layers are divided and spaced apart from one another by a gap 232. If desired, the inner layers 226 could be spaced close together or abutting one another. Alternatively, if desired the inner layer 226 could be made continuous between endwalls 216. The use of a gap 232 reduces material costs and allows a weight savings for the carton.

The inner sidewall layers 226 have opposed free edges 236 which are spaced apart, one edge on either side of gap 32. The intermediate sidewall layers 228 have recesses formed by stepped, opposed edges 238 which include an upper portion 240, a downwardly facing intermediate portion 244, a side portion 246 and lower portions 242. The side portions 246 are preferably substantially vertical so as to receive the side edges of a locking tab. The edges 242, 244 are preferably cut on an angle to the direction of corrugation C. In the preferred embodiment, the edge portions 244 are preferably upwardly inclined toward one another while the lower portions 242 are downwardly inclined toward one another. Edges 242 are terminated at the substantially vertical side edges 258 of the layers 228.

The lid members 218, 220 are preferably partially overlapping at their free edges, and lid 220 is preferably folded under the overlying lid member 218. A pair of locking tabs 270 are carried adjacent the free edge of lid 218. The locking tabs 270 have a generally inverted T-shape with an enlarged head portion 271 received in pocket 254, and a stem portion 272 extending from lid 218. As with the preceding embodiment, the locking tab 270 has a pair of opposed locking ear portions 276, 278 with inclined upwardly converging locking edges 280, 282. Unlike the locking tab 70 described above, the locking tab 270 of carton 210 preferably further includes a pointed, preferably substantially triangular leading, lower end 274 with inclined edges 275.

Figure 8:
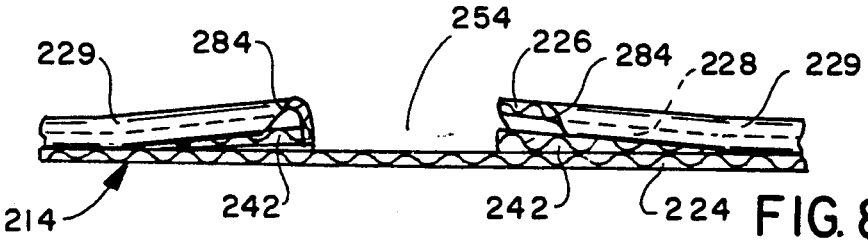
FIG. 8 is a top plan view of a pocket portion thereof.
Figure 9:
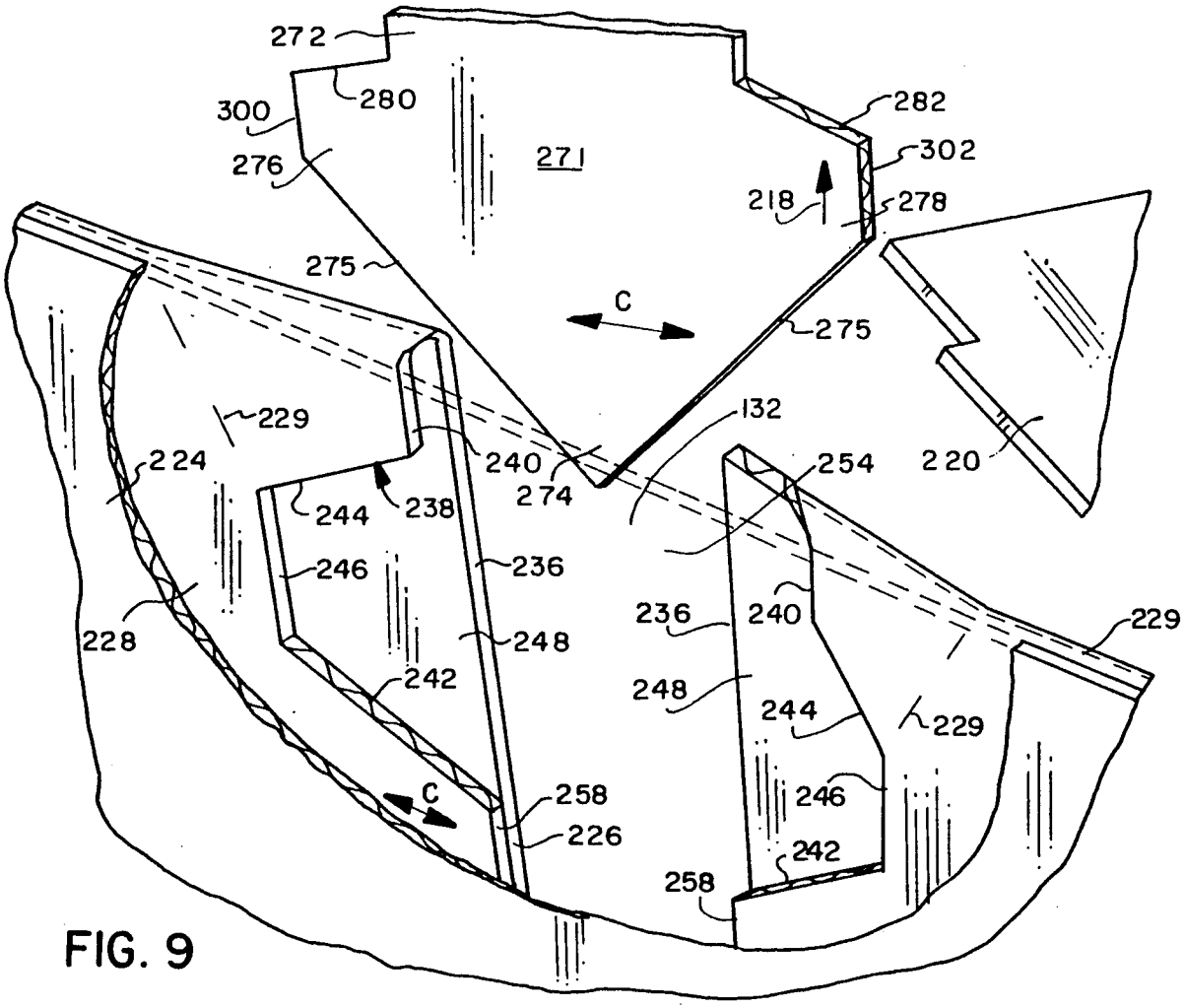
FIG. 9 is a fragmentary perspective view of the pocket.

According to one aspect of the present invention, the stepped edges 238 expose end portions 248 of inner sidewall layer 226 so as to form a pocket 254 between the inner and outer sidewall layers 224, 226, which is bounded by the stepped edges 238. The stepped edges 238 form a recess exposing edge surface portions 248 of panel 226. Unlike the preceding embodiment, the carton 210 has outer sidewall layers 224 which are continuous, uninterrupted from one endwall to the other. With the omission of a recess as in the preceding embodiment, a greater degree of protection is provided against product pilferage since locking surfaces are not exposed. In the second preferred embodiment of carton 210, the outer sidewall layer 224 completely covers the pocket 254. Accordingly, it is preferred that a gap or entrance way be provided in the triple-layer sidewall construction to allow entry of locking tab 270 between the sidewall layers. Referring to FIG. 8, it can be seen that the inner sidewall layers 226 and the upper portions of the intermediate sidewall layers 228 are inclined, at their opposed edge portions toward the interior of carton 210.

Figure 10:
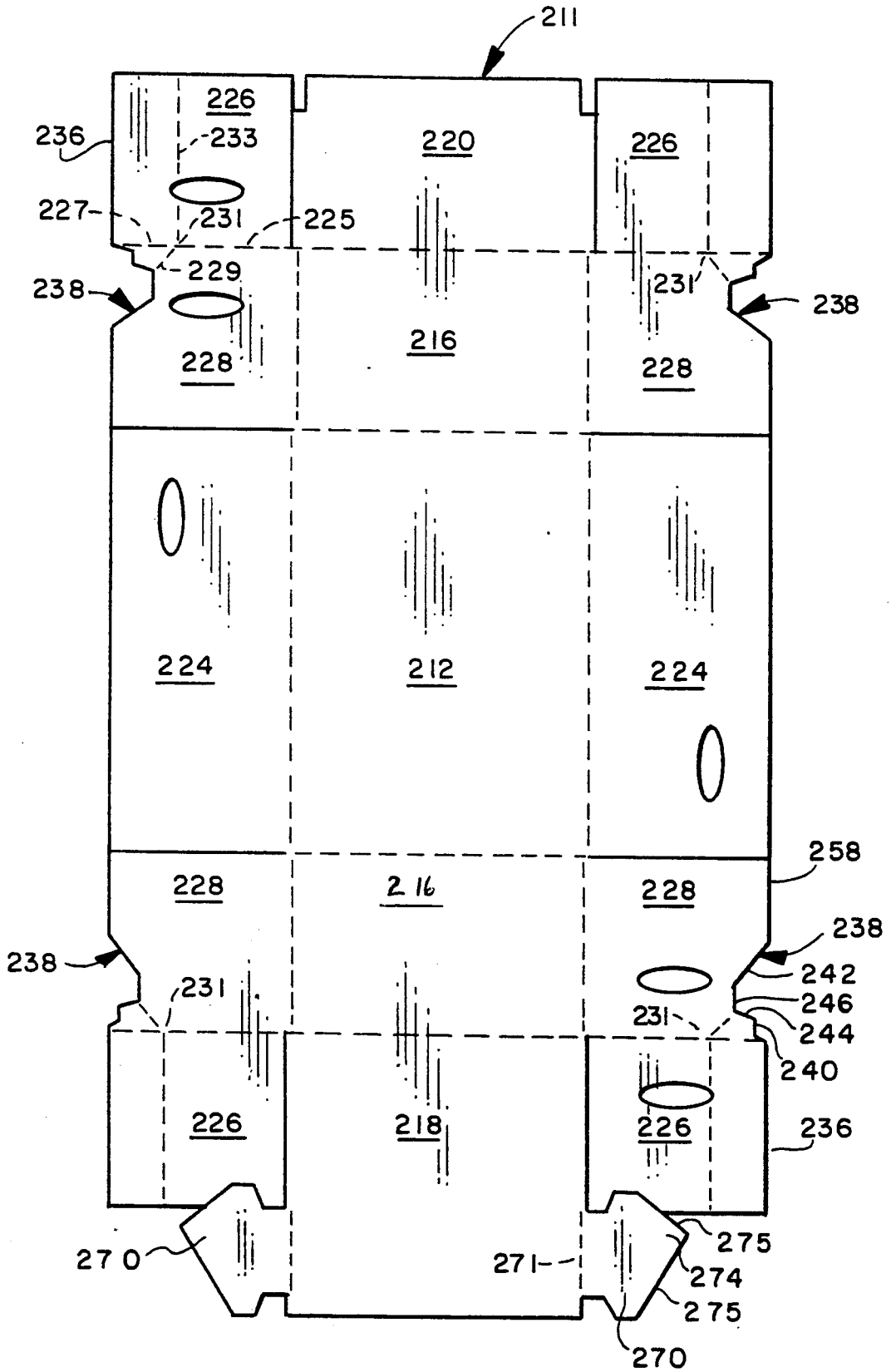
FIG. 10 is a plan view of a blank from which the carton of FIGS. 5–7 is constructed.

Referring to FIG. 10, a carton blank 211 is folded and adhesively secured to form carton 210. The blank has panels 226, 228 at each corner, joined together by fold lines having first and second portions 225, 227 respectively. The fold line portions 227 extend to the outer periphery of the blank 211 and are angled with respect to fold line portion 225, toward inner panels 226. A line of weakness 229 is formed in intermediate panel 228 and extends from the intersection of edges 244, 246 of recess 238 to the point of joinder 231 of fold lines 225, 227. A line of weakness 233 extends from point 231, generally parallel to edge 236 of panel 226. The fold lines 225, 227 preferably comprise lines of weakness, and lines 227, 229 and 233 cooperate to form the inward inclination of upper portions of sidewall panels 226, 228 as shown in FIG. 8.

In use, locking tab 270 is inserted in pocket 254 with the pointed, lower end 274 of locking tab entering the substantial gap formed between the upper portions 240 of the intermediate sidewall layers 228. As can be seen in FIG. 8, the fold line 229 at the upper edge of the sidewall construction has edges 284 comprising a transitioning cut between the inner and intermediate sidewall layers, which cut is angled so as to converge toward the interior of carton 210. Thus, as substantially wider portions of the pointed end 274 of locking tab 270 enter the pocket 254, edges 275 of the locking tab cam against the transition edges 284 of the sidewall, guiding the locking tab 270 between the upper portions 240 of intermediate sidewall 228, and the outer sidewall 224, which, as mentioned extends the full height of the sidewall construction.

The locking ears 276, 278 are thereby made to slide across the upper portions 240 of intermediate sidewall layer 228. As the locking tabs 270 continue to be inserted between the layers of the carton sidewall, the bottom inclined edges 275 of locking tab will contact the inclined edges 242 of the intermediate sidewall layer 228, with the vertical edges 300, 302 of the locking ears 276, 278 being guided by the portions 246 of intermediate sidewall layer edge 238. As mentioned above, the upper portions of the inner and intermediate sidewall layers are inclined toward the carton interior. However, insertion of the locking tab past the upper sidewall portions causes a slight amount of prying between the outer and intermediate sidewall layers, which sets up a force to align the locking tab 270 substantially coplanar with the intermediate sidewall layer 228, thus bringing the upper inclined locking edges 280, 282 of the locking tab into abutting alignment with the edges 244 of the intermediate sidewall layers. The abutting edges of the locking tab and intermediate sidewall layers forming pocket 254 are preferably cut at an angle to the direction of corrugation to further improve the strength of the locking arrangement.

The drawings and the foregoing descriptions are not intended to represent the only forms of the invention in regard to the details of its construction and manner of operation. Changes in form and in the proportion parts, as well as the substitution of equivalents, are of contemplated as circumstances may suggest or render expedient; and although specific terms have been employed, they are intended in a generic and descriptive sense only and not for the purposes of limitation, the scope of the invention being delineated by the following claims.

What is claimed is:

1. Carton apparatus having triple layer sidewalls, formed from a one-piece blank, comprising:

a floor panel having two pairs of opposed sides;

a pair of opposed endwall panels hingedly connected to one of the pairs of opposed sides of said floor panel, the endwall panels each having opposed sides;

first and second lid panels in serial succession with said endwall panels and with said floor panel and hingedly connected to respective ones of said endwall panels along hinge lines;

a pair of outer sidewall panels hingedly connected to the other of the pairs of opposed sides of said floor panel;

a sidewall subassembly coupled to each side of said endwall panels, each sidewall subassembly comprising hingedly connected inner and intermediate sidewall panels folded against one another with said intermediate sidewall panels having free end portions with upper and lower parts and said sidewall subassemblies arranged in pairs, each pair overlying a respective common outer sidewall panel so that said intermediate sidewall panels of each pair have mutually opposed free end portions, the opposed intermediate sidewall panel free end portions of each pair being spaced from one another so as to expose portions of adjacent inner sidewall panels of the pair folded thereagainst so as to define a pocket between adjacent ones of said inner and outer sidewall panels, the intermediate sidewall free end portions of each pair of sidewall subassemblies having stepped edges with the upper parts of the free end portions spaced closer together than the lower parts so as to form a downwardly facing locking edge; and locking tabs carried on said first lid panel, having an inverted T-shape configuration with a stem portion extending from said first lid panel and locking ears laterally extending from the stem portion so as to be receivable in one of said pockets so as to engage the locking edges located adjacent said one pocket.

2. The carton apparatus according to claim 1 wherein said locking ears include upper, angled locking edges upwardly converging toward one another.

3. The carton apparatus according to claim 1 wherein said intermediate sidewall layer stepped edges have upper and lower parts extending in generally parallel directions, and further include an intermediate edge part therebetween extending in a direction generally non-perpendicular with respect to the adjacent upper and lower parts.

4. The carton apparatus according to claim 3 wherein said sidewall subassemblies are arranged in pairs with free end portions of the sidewall subassemblies opposing one another, the intermediate edge parts of the intermediate sidewall panels of a pair being upwardly converging toward one another.

5. The carton apparatus according to claim 1 wherein said inner and intermediate sidewalls define recesses opening to the pocket formed by the inner sidewalls.

6. The carton apparatus according to claim 5 wherein said sidewall recesses are dimensioned so as to expose the upper parts of adjacent ones of said intermediate sidewall panel free end portions.

7. The carton apparatus according to claim 1 wherein said outer sidewall panels continuously extend between respective pairs of said sidewall subassemblies so as to enclose the pocket located adjacent the respective outer sidewall panel.

8. The carton apparatus according to claim 7 wherein said free end portions of said intermediate and inner sidewall panels are spaced from respective adjacent outer sidewall panels so as to form a gap therewith through which a locking tab is inserted for entry into the pocket associated with the outer sidewall panel.

9. The carton apparatus according to claim 8 wherein said locking tabs include downwardly converging guiding edges.

10. The carton apparatus according to claim 8 wherein said locking tabs define downwardly extending pointed ends.

11. The carton apparatus according to claim 8 wherein respective ones of said inner and said intermediate sidewall panels are hingedly connected to each other along fold lines having a first generally straight line portion and a second linear portion angularly displaced from the first portion toward respective ones of the inner sidewall panels which are connected by respective fold lines, said intermediate sidewall panels connected by respective fold lines defining lines of weakness extending from the stepped edges of respective sidewall panels to a preselected point adjacent the first fold line portion adjacent the respective sidewall panels so as to form an acute angle therewith and said inner sidewall panels connected by the fold lines defining a line of weakness having a first end adjacent the preselected point and extending away from the respective fold lines and respective adjacent intermediate sidewall panel lines of weakness.

12. Carton apparatus having triple layer sidewalls, formed from a one-piece blank, comprising:

a floor panel having two pairs of opposed sides;

a pair of opposed sidewall panels hingedly connected to one of the pairs of opposed sides of said floor panel, the endwall panels each having opposed sides;

first and second lid panels in serial succession with said endwall panels and with said floor panel and hingedly connected to respective ones of said endwall panels along hinge lines;

a pair of outer sidewall panels hingedly connected to the pairs of opposed sides of said floor panel;

a sidewall subassembly coupled to each side of said endwall panels, with pairs of sidewall subassemblies overlain by a respective outer sidewall panels, each sidewall subassembly comprising hingedly connected inner and intermediate sidewall panels, with one of said inner and said intermediate sidewall panels of each subassembly hingedly connected to a side of a respective endwall panel;

said intermediate sidewall panels cooperating with adjacent ones of said inner and outer sidewall panels to define a cavity at mid-portions of respective outer sidewall panels, each cavity located between spaced apart portions of said adjacent inner and outer sidewall panels, each said cavity bounded at an upper end by locking portions of adjacent ones of said intermediate sidewall panels, said locking portions having downwardly facing locking edges; and locking tabs carried on said first lid panel, having an inverted T-shape configuration with a stem portion extending from said first lid panel and locking ears laterally extending from the stem portion so as to be receivable in one of said pockets so as to engage the locking edges located adjacent said one pocket.

* * * * *

UNITED STATES PATENT AND TRADEMARK OFFICE

CERTIFICATE OF CORRECTION

PATENT NO. : 5,139,195

DATED : August 18, 1992

INVENTOR(S) : McClure

It is certified that error appears in the above-identified patent and that said Letters Patent is hereby corrected as shown below:

Column 3, line 52, after "tab 70" insert a period.
Column 3, line 53, change "The" to --the--.

Column 5, line 62, after "proportion" insert --of--.
Column 5, line 63, after "are" delete "of".

IN THE CLAIMS:

Column 8, line 1, change "sidewall" to --endwall--.

Signed and Sealed this

Eighth Day of February, 1994

*Attest:*

*Attesting Officer*

Bruce Lehman

BRUCE LEHMAN

*Commissioner of Patents and Trademarks*